United States Patent [19]

Higginbotham, Sr. et al.

[11] Patent Number: 4,620,843

[45] Date of Patent: Nov. 4, 1986

[54] CHILD'S CONSTRUCTION TOY

[76] Inventors: Richard H. Higginbotham, Sr.; Richard H. Higginbotham, Jr., both of 1303A Sherwood Forest, Houston, Tex. 77043

[21] Appl. No.: 639,491

[22] Filed: Aug. 9, 1984

Related U.S. Application Data

[63] Continuation-in-part of Ser. No. 410,498, Aug. 23, 1982, abandoned.

[51] Int. Cl.[4] ..... A63H 17/00; A63G 11/00

[52] U.S. Cl. ..... 446/94; 272/54; 272/56.5 R; 446/95; 446/115

[58] Field of Search ..... 272/30, 54, 111, 113, 272/56.5 R; 446/85, 93, 94, 95, 96, 102, 103, 104, 126

[56] References Cited

U.S. PATENT DOCUMENTS

| | | | |
|---|---|---|---|
| 699,834 | 5/1902 | Cannon | 446/96 |
| 1,441,940 | 1/1923 | Nafe . | |
| 1,511,124 | 10/1924 | Hart | 446/94 |
| 1,519,432 | 12/1924 | Ziemss | 272/54 |
| 2,382,982 | 8/1945 | Elliott | 446/94 |
| 2,446,770 | 8/1948 | Kershisnik | 446/96 |
| 2,545,155 | 3/1951 | Logan | 446/94 |
| 2,751,706 | 6/1956 | Metal | 446/114 |
| 3,109,645 | 11/1963 | Thorson | 272/54 |
| 3,339,920 | 9/1967 | Moritz | 272/60 |
| 3,982,352 | 9/1976 | Branson | 446/96 |

FOREIGN PATENT DOCUMENTS

| | | |
|---|---|---|
| 694658 | 12/1930 | France . |
| 902734 | 9/1945 | France . |
| 907216 | 3/1946 | France . |
| 1488653 | 10/1977 | United Kingdom . |

*Primary Examiner*—F. Barry Shay

*Attorney, Agent, or Firm*—Gunn, Lee & Jackson

[57] ABSTRACT

A constructional toy is disclosed which may be assembled in numerous different configurations employing four basic components which include a triangularly-shaped component, a rectangularly-shaped component and two elongated board components. A pair of wheels are mounted on the triangularly-shaped and rectangularly-shaped components. From these four basic components, the plurality of toys may be constructed.

6 Claims, 22 Drawing Figures

Fig. 10
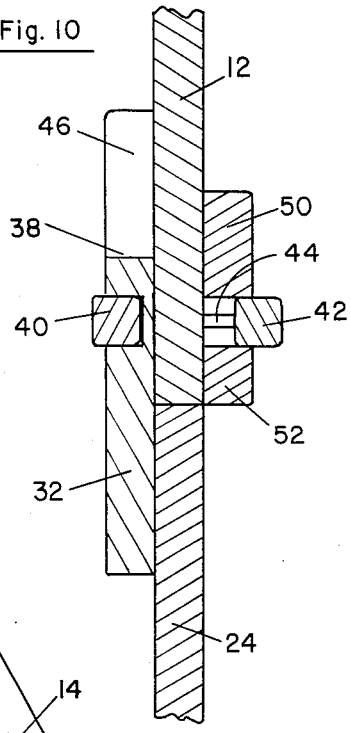
Fig. 8
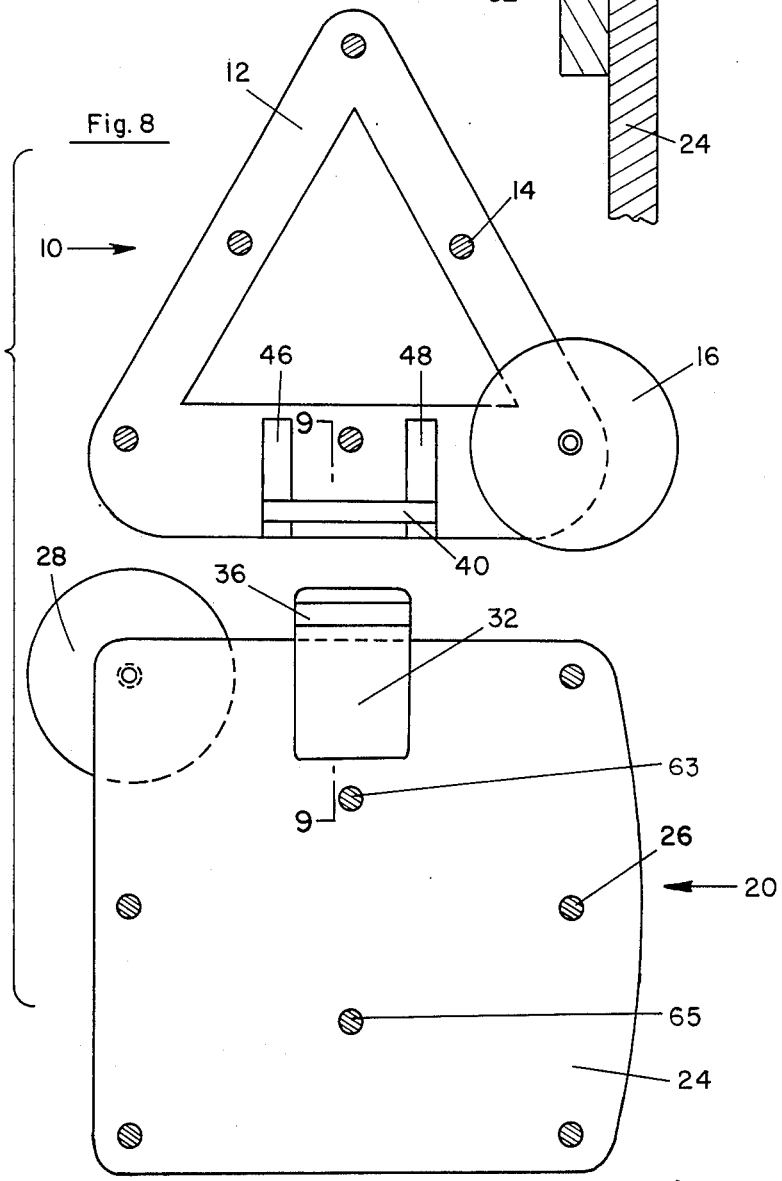
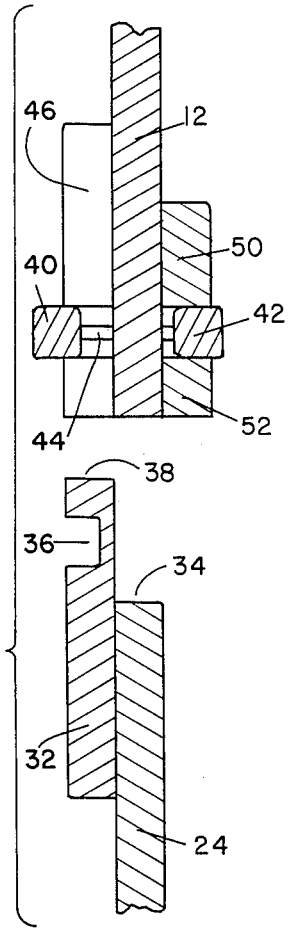
Fig. 9

CHILD'S CONSTRUCTION TOY

RELATED APPLICATIONS

This application is a continuation-in-part application of U.S. Ser. No. 410,498 filed on Aug. 23, 1982, now abandoned.

BACKGROUND OF THE INVENTION

This invention relates to toys, particularly toys including a plurality of interlocking components which may be disassembled and reassembled into different configurations.

Generally, toys for children do not permit a child to fully use his imagination and creativity. Toys for the most part are constructed as a single or unitary item and serve only a single function. Those toys which require some assembly usually comprise small scale elements to form a miniature of the article being constructed. Such small scale toys do not permit the child to use the toy which he has constructed. The child very quickly loses interest in the toy which has limited utility and presents no diversity or challenges his creativity and imaginativeness.

It is therefore an object of the present invention to provide a construction toy which utilizes a plurality of basic components which interlock with each other and are capable of assembly into different configurations of toys.

Another feature of the invention is to provide a construction toy comprising simple and elementary components which are easily put together or separated. This is accomplished by employing interlocking components with simple and easily manipulated fasteners.

SUMMARY OF THE INVENTION

The present invention comprises four basic components which interlock to form various toys. One of the components is triangularly-shaped comprising two triangular mem bers spaced from each other and joined along their respective peripheries by a plurality of dowels. A rectangular component is similarly constructed with two spaced rectangular members. The remaining two components are elongated board members, one including a pair of latches mounted on its undersurface and the other including a plurality of transversely extending slats midway of its undersurface. From these four basic components, a number of toys may be constructed.

BRIEF DESCRIPTION THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 8 is a side view depicting the cooperation of the locking mechanism on the triangularly-shaped component and the recctangularly-shaped component;

FIG. 9 is a side view, partially broken away, of the locking mechanism shown in FIG. 8;

FIG. 10 is a side view, partially broken away, of mechanism in FIG. 9 shown in the engaged position.

DETAILED DESCRIPTION OF THE INVENTION

Figure 1:
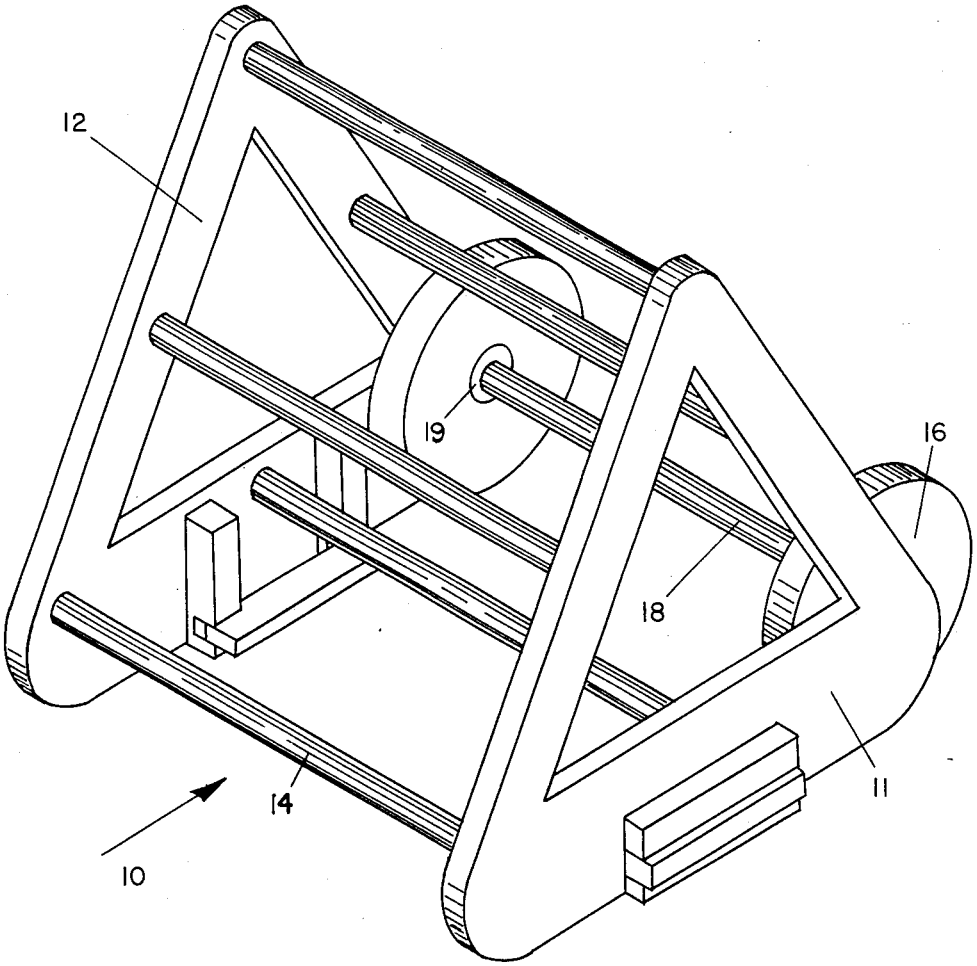
FIG. 1 is a perspective view of the triangular component of the invention.

The basic components of the invention are shown in FIGS. 1 through 6. Referring first to FIG. 1, the triangular component is generally identified by reference numeral 10. The component 10 includes two triangularly-shaped planar side members 11 and 12 spaced from each other and joined along their respective peripheries by a plurality of dowels 14. The triangular side members 11 and 12 include a centrally located triangular cut-out portion reducing the weight of the members 11 and 12 and thus enabling +he component 10 to be easily lifted and manipulated by a child.

A pair of wheels 16 are rotatably mounted on a dowel 18 which is mounted between the triangular side members 11 and 12. The dowel 18 functions as the axle for the wheels 16. Locking nuts 19 journaled about the axle dowel 18 adjacent to the inner face of the the wheels 16 hold the wheels 16 in spaced relation. The locking nuts 19 are fixed to the axle dowel 18 with set screws or the like. The locking nuts 19 hold the wheels 16 in position, yet permit the spaced wheels 16 to freely rotate about the axle dowel 18.

Figure 2:
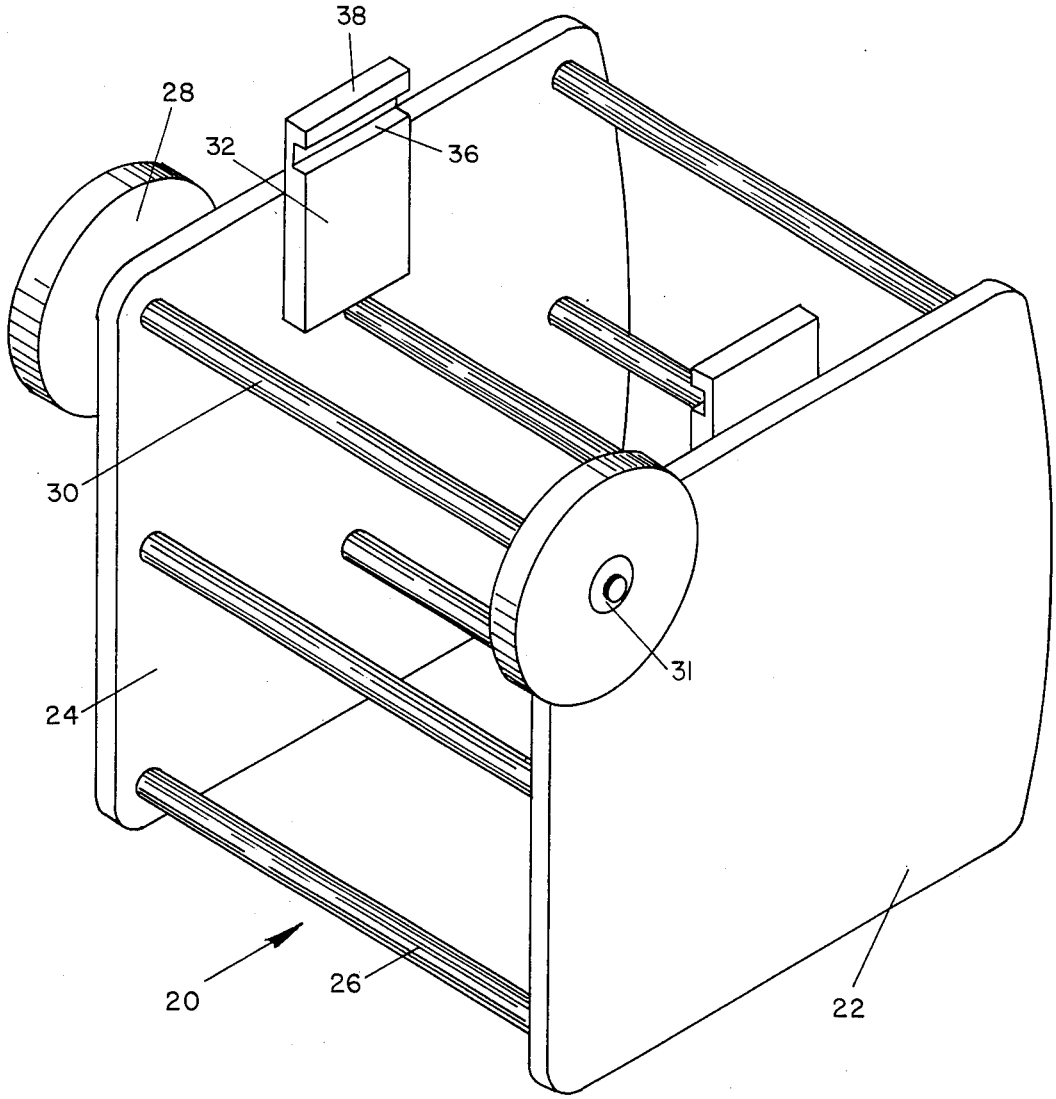
FIG. 2 is a perspective view of the rectangular component of the invention.

Referring now to FIG. 2, the rectangularly-shaped component 20 is shown. The component 20 includes two rectangularly-shaped members 22 and 24 which are spaced from each other and joined along their respective peripheries by a plurality of dowels 26. A pair of wheels 28 are rotatably mounted on the components 20 as shown in FIG. 2. The wheels 28 are on the outside. The wheels 28 are mounted externally of the members 22 and 24 on a dowel 30 which functions as the axle for the wheels 28. The axle dowel 30 extends through the side members 22 and 24 a sufficient distance for receiving a locking nut 31 thereon for holding the wheels 28 on the axle dowel 30.

Referring now to FIGS. 8 through 10, the locking mechanism for connecting the components 10 and 20 is shown in greater detail. For the sake of clarity in the drawings, only the side members 12 and 24 of the components 10 and 20 are shown in FIG. 8; it being understood that the side members 11 and 22, not shown in the drawing, cooperate in the same manner and have substantially identical locking mechanisms for releasably connecting the component 10 and 20.

The locking mechanism shown in FIGS. 8 through 10 comprises separable members mounted on the side members 12 and 24. Mounted on the member 24 is a block 32 rectangular in shape and having a portion projecting beyond the edge 34 of the side member 24. A transverse groove 36 is formed in the block 32 adjacent the distal end 38 thereof.

Cooperatively mounted on the side member 12 and in substantial alignment with the a block 32 is a latch comprising a pair of locking members 40 and 42 separated by connecting rods 44. A pair of guide members 46 and 48 define a slot there between for receiving the projecting end of the block 32.

The locking members 40 and 42 are positioned on opposite sides of the side member 12 as shown in FIGS. 9 and 10. The connecting rods 44 extend through the side member 12 connecting the locking members 40 and 42 and thereby permitting limited reciprocal movement of the locking members 40 and 42 between locked and unlocked positions. A pair of transverse guide members 50 and 52 slideably engage the locking member 42 on opposite sides. The transverse guide members 50 and 52 provide lateral support for the locking member 42 and substantially close the gap existing between the locking member 42 and the side member 12 when the latch is moved to the lock position shown in FIG. 10. Closure of the gap prevents inadvertent pinching of fingers upon minuplation of the lock mechanism. The lock mechanism aids a child's ability to easily assemble and disassemble the components 10 and 20.

Figure 3:
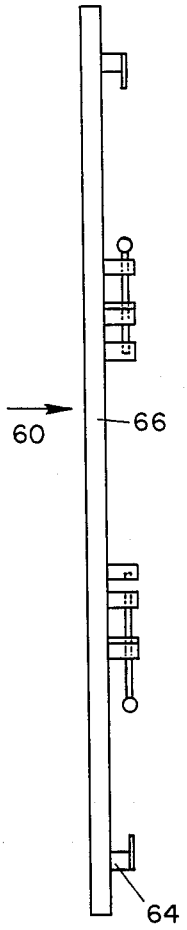
FIG. 3 is a side view of the enlongated board component of the invention incorporating a pair of latches mounted on its undersurface.
Figure 4:
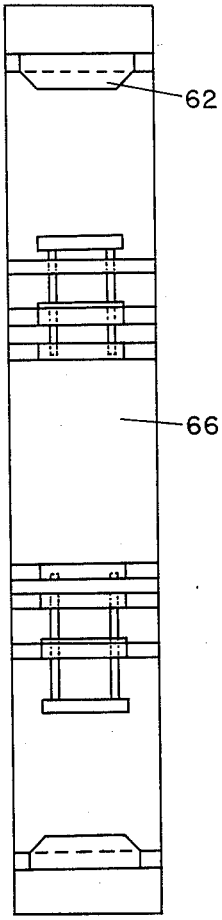
FIG. 4 is a plan view of the enlongated board component shown in FIG. 3.
Figure 7:
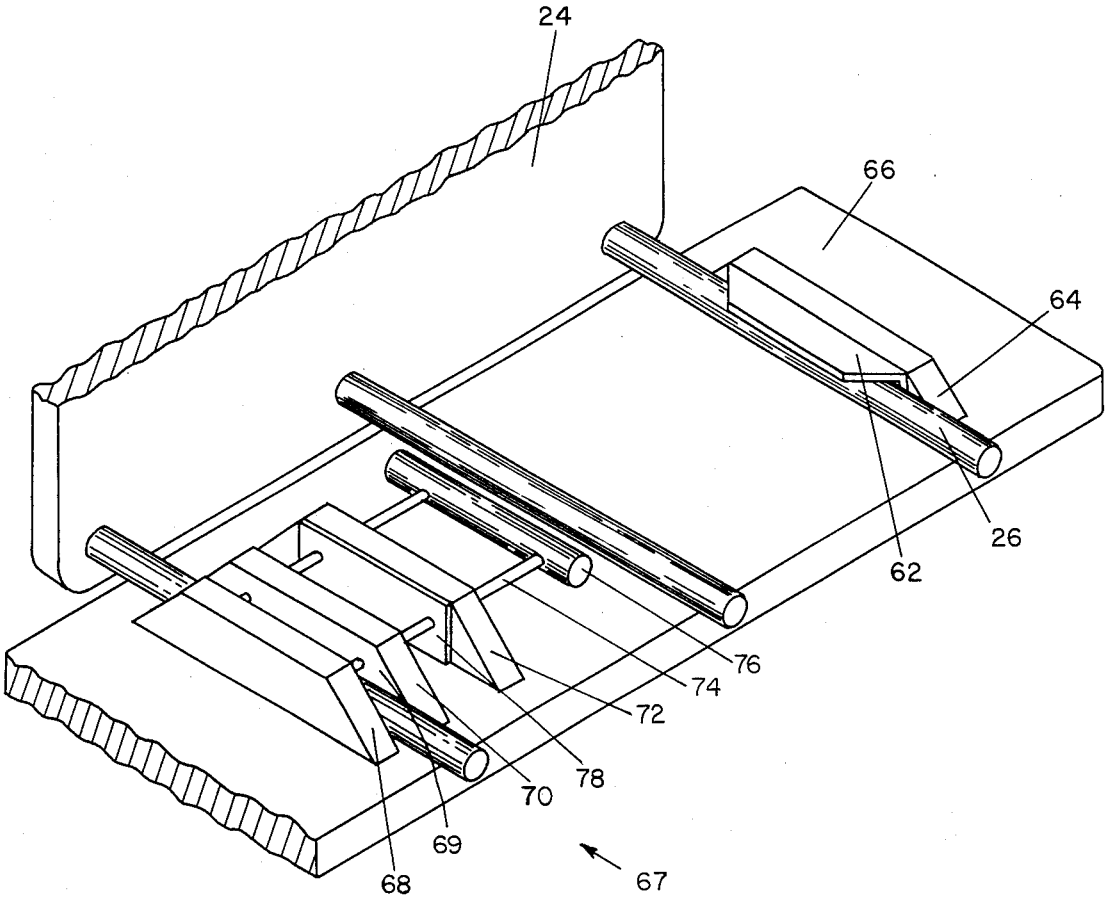
FIG. 7 is an enlarged perspective view of the latch mounted on the enlongated board component shown in FIGS. 3 and 4.
Figure 11:
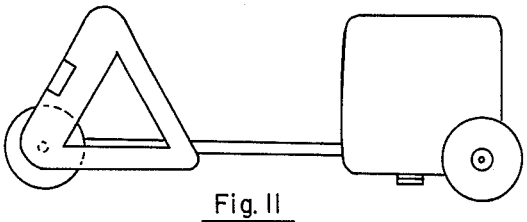
FIGS. 11–22 are diagramatic views showing some of the different combinations which may be effected using one or more components of the present invention.
Figure 12:
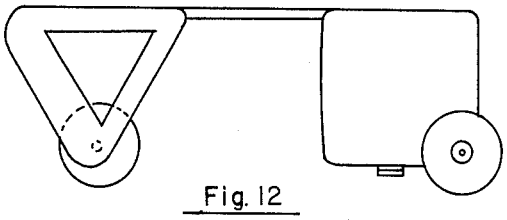

Turning now to FIGS. 3 and 4, the enlongated board component 60 is shown. The component 60 is of sufficient thickness to support the weight of a child without buckling. An overhanging hook 62 is mounted on the bottom surface 66 of the component 60 near each end thereof. The hook 62 extends parallel to the bottom surface of the component 60 and is spaced therefrom by a spacer 64 perpendicularly mounted to the component 60. The hook member 62, spacer 64 and bottom surface 66 of the component 60 form a channel for receiving a dowel 14 or 26 of the components 10 and 20, respectively, as best shown in FIG. 7.

Figure 18:
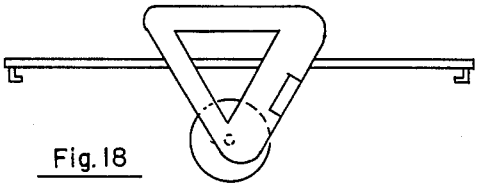
Figure 19:
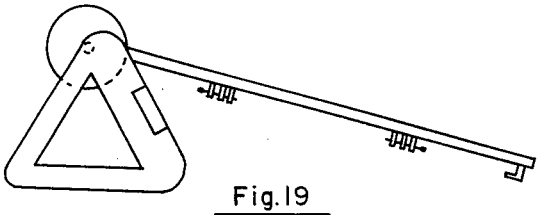
Figure 20:
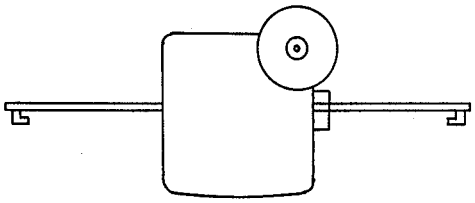

A pair of locking latches 67 are mounted to the surface 66 of the board component 60 a predetermined distance from the hooks 62. The distance between the hooks 62 and the latches 67 is equal to twice the distance separating the dowels on the components 10 and 20 so that at least one dowel provides additional support for the board component 60 between the hooks 62 and latches 67 as best shown in FIG. 7. The dowels 14 and 26 are equally spaced about the peripheries of the components 10 and 20, respectively. The distance separating the latches 67 on the board component 60 is equal to the distance separating the dowels on the components 10 and 20. In the position shown in FIG. 18, the board component 60 is mounted to the component 10 by locking the latches 67 about two dowels 14 connecting the side members 11 and 12 at about the midpoint along each longitudinal edge of the component 10. In FIG. 20, the component 60 is locked in position about intermediate dowels 63 and 65. However, the board component 60 may also be locked about any two adjacent dowels on the components 10 and 20 to form other configurations not shown in the drawings.

The latches 67 comprise a plurality of spaced and upstanding support blocks. The support blocks 68 and 70 define a channel therebetween for receiving a dowel of the components 10 and 20. In FIG. 7, a dowel 26 of the component 20 is shown disposed in the channel 69, for illustrative purposes. The latches 67 also include a pair of retaining rods 74 extending from a handle 76. The retaining rods 74 extend through apertures in the support blocks 70 and 72, and the ends thereof are received in holes formed in the support block 68. The rods 74 are maintained in alignment with the apertures extending through the support blocks 70 and 72 by a spacer plate 78 positioned between the support blocks 70 and 72. The spacer 78 also limits the movement of the rods 74 so that the handle 76 and rods 74 may not be separated from the support blocks 70 and 72. Use of the locking latches 67 is accomplished by pushing the handle 76 to the left as shown in FIG. 7. When in the closed or locked position, the handle 76 does not contact the support block 72, the travel of the rods 74 and handle 76 being limited by engagement of the spacer 78 with the back surface of the support block 70. A gap is provided so that the handle 76 may easily be grasped for unlocking the locking latch and prevention of inadvertent pinching of fingers when the locking latch is moved to the lock position.

Figure 5:
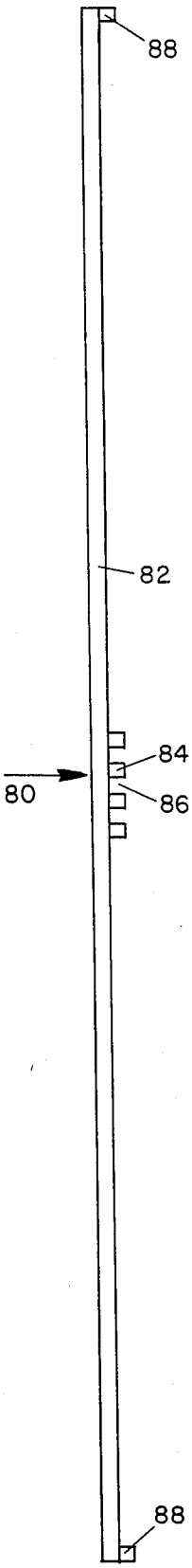
FIG. 5 is a side view of the enlongated board component of the invention incorporating a plurality of transversely extending slats mounted on its undersurface.
Figure 6:
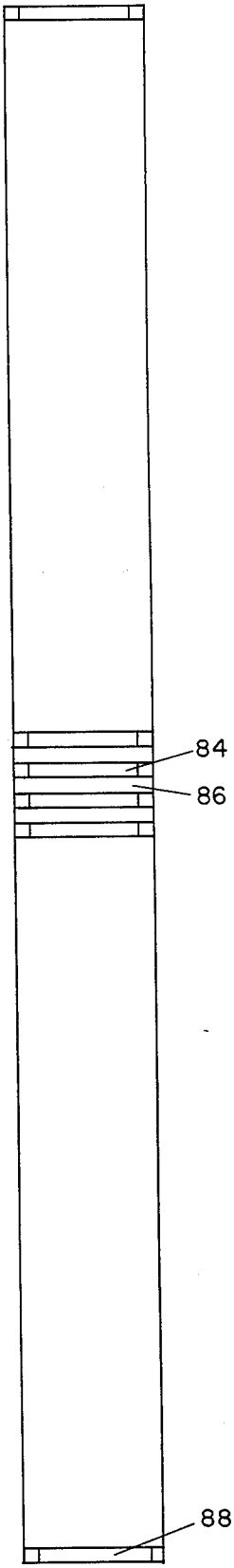
FIG. 6 is a plan view of the enlongated board component shown in FIG. 5.
Figure 15:
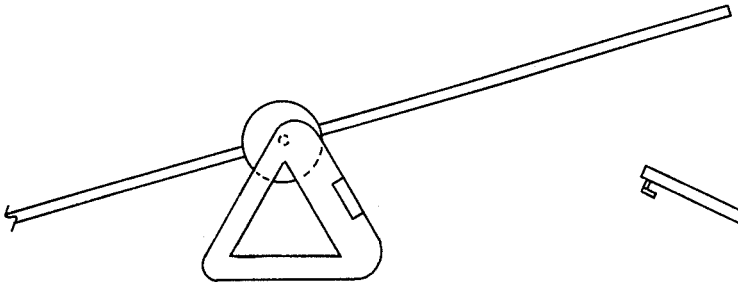
Figure 16:
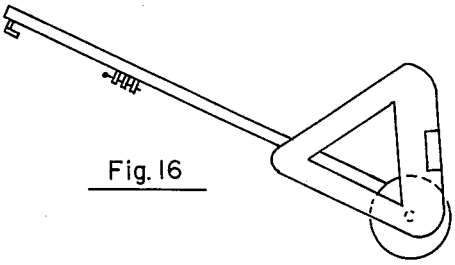
Figure 17:
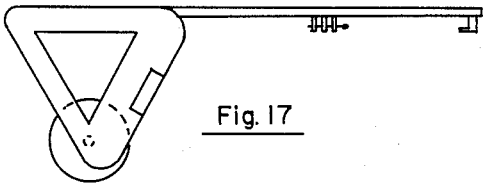

In FIGS. 5 and 6, the enlongate board component 80 is shown. The board component 80 includes a bottom surface 82 which is divided into substantially two equal segments by a plurality of transversely extending slats 84 mounted at approximately the mid point of the surface 82. The slats 84 are so arranged as to form channels having a width slightly larger than the diameter of the dowels on the components 10 and 20. Four slats are shown for illustrative purposes. It is understood that fewer or a greater number of slats 84 may be employed as desired. More than one channel is desirable to compensate for the different weights of children when using the invention of this disclosure to create a seesaw as shown in FIG. 15. If the children are approximately equal in weight, the center channel 86 would be used as the pivotal axis. When children of different weight desire to use the seesaw, the channel nearest the heavier of the two children would be used as the pivotal axis.

Figure 13:
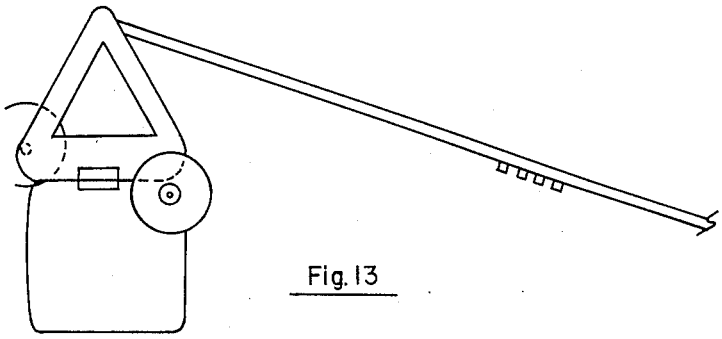
Figure 14:
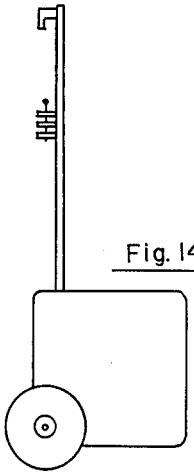
Figure 21:
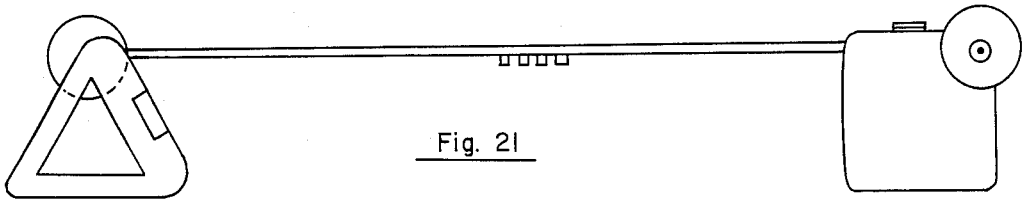
Figure 22:
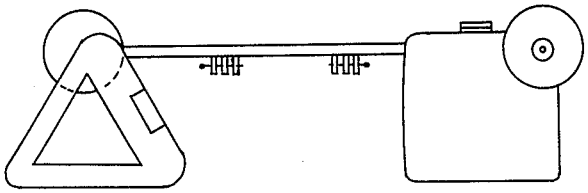

Bumper bars 88 are provided at each end of the component 80 as shown in FIGS. 5 and 6. The bars 88 are particularly useful when the invention is being used in the seesaw configuration shown in FIG. 15. The bars 88 act as bumpers for each end of the board component 80. By spacing the end of the component 80 from the ground, children riding the seesaw may hold on to the board component 80 whithout fear of pinched fingers or toes. The bars 88 are also used for hooking an end of the board component 80 to the components 10 and 20 as shown in FIGS. 13 and 21. The slats 84 and bars 88 are chamfered at their exposed corners to improve mounting by eliminating the sharp corners.

In FIGS. 11 through 22, different structural configurations to form different toys are shown. The depicted toys are shown for illustrative purposes only, it being understood that the invention of the present disclosure is not limited to the construction only of the toys shown in FIGS. 11 through 22. The construction toy of the invention takes advantage of the creativity and imaginativeness of child's play and the number of toys that can be created from the four basic components of the invention is limited only by the child's imagination. The components of the invention are manufactured of light weight material such as plywood or press wood, yet they have sufficient thickness to support the weight of a child without buckling or warping.

The components 10 and 20 are substantially the same in overall dimensions. That is, the altitude of the component 10 is substantially equal to at least one outside dimension of the component 20 as best shown in FIGS. 11, 12, 21 and 22. The dowels on the components 10 and 20 are mutually prallel and equal in length. The spacing between the dowels 14 on the component 10 is substantially the same as the spacing between the dowels 26 on the component 20. Likewise, the spacing between dowels 63 and 65 on the component 20 is substantially equal to the spacing between adjacent dowels 26 along the peripheral edges of the component 20. The components 10 and 20 are provided with a lock mechanism for locking the components together to form a stable structure. In addition, conformity of the components 10 and 20 permits the board components 60 to be interchangeably locked to the components 10 and 20 to form various stable structures as illustrated in FIGS. 11, 12, 21 and 22.

the foregoing is directed to the preferred embodiments of the present invention, other and further embodimennts of the invention may be devised without departing from the basic concept thereof, and the scope thereof is determined by the claims which follow.

What is claimed is:

1. A construction toy capable of being converted into a plurality of different toy configurations, comprising:

(a) a triangularly-shaped component formed of two matching planar, parallel, and mutually spaced triangular members joined along their respective peripheries by a first set of dowels, said dowels of said first set being mutually parallel, equal in length and substantially equally spaced about the periphery of said triangular members;

(b) a rectangularly-shaped component formed of two matching planar, prallel, and mutually spaced rectangular members joined along their respective peripheries by a second set of dowels, said dowels of said second set being mutually parallel, equal in length and substantially equally spaced about the periphery of said rectangular members, at least three of said dowels of said second set being spaced along one side of said rectangular members and being spaced by substantially the same distance as the dowels of said first set, the triangular members of said triangularly-shaped component having altitudes substantially equal to at least one outside dimension of the rectangular members of said rectangularly-shaped component;

(c) a first elongated board component having means for selectively hooking over a dowel of either of said sets mounted adjacent each end of said first board component on the bottom surface thereof;

(d) a second elongated board component having a plurality of transversely extending slats depending midway of the bottom surface of said second board component, said slats being arranged to form dowel receiving channels therebetween; and (e) lock means on said triangularly shaped and rectangularly shaped components for fastening them securely to each other to form a stable structure.

2. The construction toy of claim 1 wherein said lock means comprises a block member mounted to said rectangular members, said block member including a portion projecting beyond the periphery of said rectangular members, said lock means further including a slidable lock bar assembly mounted to said triangular members and adapted to be placed in cooperative alignment for locking engagement with said block member mounted to said rectangular members.

3. The construction toy of claim 1 further including latch means mounted to the bottom surface of said first board component, said latch means being spaced from said hook means a distance substantially equal to twice the spacing between adjacent dowels, the spacing between adjacent dowels of said first set of dowels and said second set of dowels being substantially equal.

4. The construction toy of claim 3 wherein said latch means cooperate to releasably lock said first board component to said triangularly-shaped component and said rectangularly-shaped component to form different toy configurations.

5. The construction toy of claim 4 further including a pair of wheels mounted on said triangularly-shaped component and said rectangularly-shaped component.

6. The apparatus of claim 3 wherein said latch means comprises a duplicate set of latches mounted to the bottom of said first board component, said latches being spaced from each other a distance substantially equal to the spacing of adjacent dowels of either said triangularly shaped or rectangularly-shaped components

* * * * *